United States Patent [19]

Jones et al.

[11] 4,104,495

[45] Aug. 1, 1978

[54] PRESSURE SWITCH AND ACTUATING MEANS RESPONSIVE TO LOW PRESSURE

[75] Inventors: William H. Jones, Villa Park; Gordon L. Astrom, Byron, both of Ill.

[73] Assignee: Eaton Corporation, Cleveland, Ohio

[21] Appl. No.: 458,948

[22] Filed: Apr. 8, 1974

Related U.S. Application Data

[63] Continuation-in-part of Ser. No. 405,225, Oct. 10, 1973, abandoned.

[51] Int. Cl.[2] ..... H01H 35/34

[52] U.S. Cl. ..... 200/83 P; 200/83 S

[58] Field of Search ..... 200/83 P, 83 W, 83 WM, 200/83 S, 83 V, 67 D, 67 DA, 275, 283

[56] References Cited

U.S. PATENT DOCUMENTS

| | | | |
|---|---|---|---|
| 2,685,650 | 8/1954 | Collins | 200/83 W |
| 3,213,244 | 10/1965 | McCarrick | 200/67 DA |
| 3,366,760 | 1/1968 | Kolze | 200/83 WM |
| 3,407,277 | 10/1968 | Chapin | 200/83 WM |
| 3,596,023 | 7/1971 | Kothe | 200/83 P |
| 3,598,946 | 8/1971 | Hanssen | 200/83 WM |
| 3,689,719 | 9/1972 | Phillips | 200/83 P |
| 3,694,597 | 9/1972 | Rosch | 200/67 D |
| 3,773,991 | 11/1973 | Krieger | 200/83 P |

*Primary Examiner*—Gerald P. Tolin
*Attorney, Agent, or Firm*—R. J. McCloskey

[57] ABSTRACT

Improved actuating mechanisms are provided in pressure switches controlling water tub fill levels in domestic appliances such as dishwashers, washing machines, etc. The mechanisms include a snap blade construction which improves contact point wear characteristics; an orifice molded into the switch's plastic body which averages transient surges in water tub levels during operation; a simplified plunger arrangement utilizing an especially configured actuator for establishing trip and reset levels of the switch; and a snap blade configuration which minimizes "contact bounce" after the contact moves from one stationary contact to the other.

4 Claims, 11 Drawing Figures

PRESSURE SWITCH AND ACTUATING MEANS RESPONSIVE TO LOW PRESSURE

This application is a continuation-in-part of my copending application, Ser. No. 405,225, filed Oct. 10, 1973, now abandoned.

BACKGROUND OF THE DISCLOSURE

This invention relates to snap acting pressure switches and more particularly to improvements in the actuating mechanisms for such switches.

The subject invention is particularly applicable to pressure switches of the type used in domestic appliances such as dishwashers, washing machines, etc. which control the water fill tub level for such appliances. However, it will be appreciated by those skilled in the art that the invention may have broader application and may be employed in any type of adjustable switch which senses varying pressures to actuate a switch blade toggle mechanism.

The mechanism for operating switches of the subject invention as contrasted to other mechanisms such as those employed in calibrating the switch are broadly defined as including (1) a diaphragm for sensing pressures,
(2) a switch blade connected to the diaphragm for completing appropriate electrical circuitry, and
(3) a spring arrangement opposing the diaphragm movement for controlling the trip and reset functions of the switch. Each component thus identified has been plagued with problems peculiar to the function of that component which heretofore has been overcome in varying degrees of success by complex structure, relatively expensive to manufacture and assemble.

Thus, it is commonly recognized that the function of the diaphram is to sense the "head" of water in the tub of the appliance and once the water-fill level is reached, the switch will trip to close an associated water valve and once the level is reduced the switch will automatically reset. However, the water in the tub is subjected to violent agitation during the operation of the machine which can vary the head pressure by as much as 4–6 inches water even though the volume of water in the tub may not materially change. Such transient fluid pressure variations can, in some instances, adversely effect the operation of the switch. Recognizing this problem, the prior art has employed restrictive orifices at the pressure inlet of the switch to "average out" the transient pressures. Because of the small orifice size thus required, nominally 0.020 inch, this has heretofore been accomplished by accurately drilling such hole in a metal piece which was soldered into a metal inlet stem which in turn was soldered to a metal cap that formed the cover for the pressure chamber of the switch. This was a costly operation, both from material and manufacturing considerations. Additionally, the orifice was subject to clogging because of its size and was also subject to damage because of its location.

A frequent problem interfering with the operation of the snap switch is the erosion due to arcing between contact points which in turn occur when controlling highly inductive motor loads such as those encountered in appliance-type motors. Prior art devices have failed to provide simplified structure to compensate for the decrease in contact force as the switch blade moves towards its center trip position. To the contrary the prior art has rigidized the actuator arm of the switch blade and thus the tendency to arc increases as the switch moves toward its center position.

Functional problems have also occurred with respect to the plunger spring arrangement which establishes trip and reset levels of the switch. In one prior art arrangement, a diaphragm post protrudes through a slot in the snap blade and the protruding end serves as a guide for a trip-reset spring which rests directly on the snap blade. Such structure does not provide a stable spring arrangement as the looseness between the post protrusion and spring along with varying angled relationships between spring and snap blade adversely effects the spring forces developed at the low end of the spring. Another spring arrangement utilizes an actuator in contact with the diaphragm post. To permit up and down movement of the snap blade's guide tongue, the diaphragm post is cut with a notch to receive the edge of the opening in the guide tongue. This necessarily results in lost motion between blade and diaphragm posts which adversely effects the determination of a precise trip point of the switch. Additionally, the actuator was free to rotate relative the spring which could adversely effect the switch point because of wear, binding, etc. Finally, complex structure keyed to the actuator has been employed when the plunger arrangement included a second spring which was compressed after some limited travel of the first spring to achieve "proportional" reset of the switch.

Another functional problem is the "contact bounce" which occurs when the movable contact moves from one stationary contact to another and the bounce is caused by the force of impact of the contact closure. A momentary loss of contact occurs during the bounce which may affect the operation of the associated electrical circuit, and arcing may occur between the contacts. Solutions attempted by the prior art include the use of a weaker toggle spring, which reduced the contact force. This reduced the bounce, but introduced other functional problems.

It is thus an object of the subject invention to provide simplified actuating means associated with the plunger arrangement, the snap switch structure and the diaphragm of a pressure switch which overcomes each and all of the above-noted disadvantages.

In accordance with the invention this object is achieved by providing a pressure switch comprising a two-piece plastic housing with a diaphragm mounted therebetween to define an expansible pressure chamber on one side thereof. A snap acting switch blade is positioned on the other side of the diaphragm. The switch blade includes an actuator tongue element carrying a contact movable between a normal and actuated position, and a movable guide tongue element within the actuator tongue operatively connected to the diaphragm for common movement therewith. The first housing portion has a bore aligned with the guide tongue element and a base at the bottom of the bore adjacent the guide tongue. The base has an opening and at least two especially configured, diametrically opposed slots extending therethrough. Adapted to fit within the base for endwise movement therein is a dog-eared, actuator element having a spherical bottom portion which contacts the guide tongue element. A first spring compressed within the bore biases the actuator against the guide tongue element. Additionally, the arrangement may include a second spring normally seated against the base and selectively compressed by the actuator dog-ears after some finite movement of the actuator has occurred. Both springs are stabilized because the fit between the dog-ears of the actuator and the grooves in the base of the bore prevent rotation of the actuator within the bore while also reducing any tendency of the actuator to become cocked within the bore.

In accordance with another aspect of the subject invention, the guide tongue element has a central hole extending therethrough, and the diaphragm post has a spherical end contacting one side of the guide tongue actuator about a circular line removed from the guide tongue's opening. The spherical surface extending from the bottom of the actuator likewise contacts the opposite side of the guide tongue. The guide tongue is thus retained for precise actuation because it is retained between opposing spherical contact surfaces. To assure alignment of the spherical surface, the diaphram post has a blind opening extending within the center of its spherical end which receives a guide stem depending from the spherical surface of the actuator.

In accordance with another aspect of the subject invention, the expansible pressure chamber communicates with a contiguous inlet molded into the plastic housing at the bottom thereof. At the base of the inlet is a wall which contains an especially sized opening which functions as a restrictive orifice for averaging transient pressure changes within the tub due to agitation, etc. The opening, being molded into a plastic part, is necessarily greater in diameter than prior art orifices formed in metal inlets. However, the opening is functionally equivalent to prior art orifices because the length of the opening through the wall is closely controlled at a larger dimension to compensate for the increase in orifice diameter.

In accordance with yet another aspect of the subject invention, the guide tongue element of the snap blade is yieldably deflectable to increase contact force prior to switch trip and thus reduce the possibility of contact point arcing. By permitting the guide tongue to deflect under the loading of the overcenter barrel spring, the vertical attitude of the spring is increased. Accordingly the increased vertical force component of the spring maintains the contacts in firm engagement with one another over a greater switch travel distance prior to trip than that of prior art blades.

In accordance with still another aspect of the invention, the switch blade has a support end attached to the housing, opposite the actuator tongue element, the element being pivotable with respect to the guide tongue at a pivot point spaced apart from the support end. The blade has a relatively flexible portion between the pivot point and the support end to partially absorb the impact forces occurring during contact closure.

BRIEF DESCRIPTION OF THE DRAWINGS

FIG. 8 is a fragmentary sectioned elevation similar to FIG. 1 showing an alternative embodiment of the invention.

DESCRIPTION OF THE PREFERRED EMBODIMENTS

Figure 1:
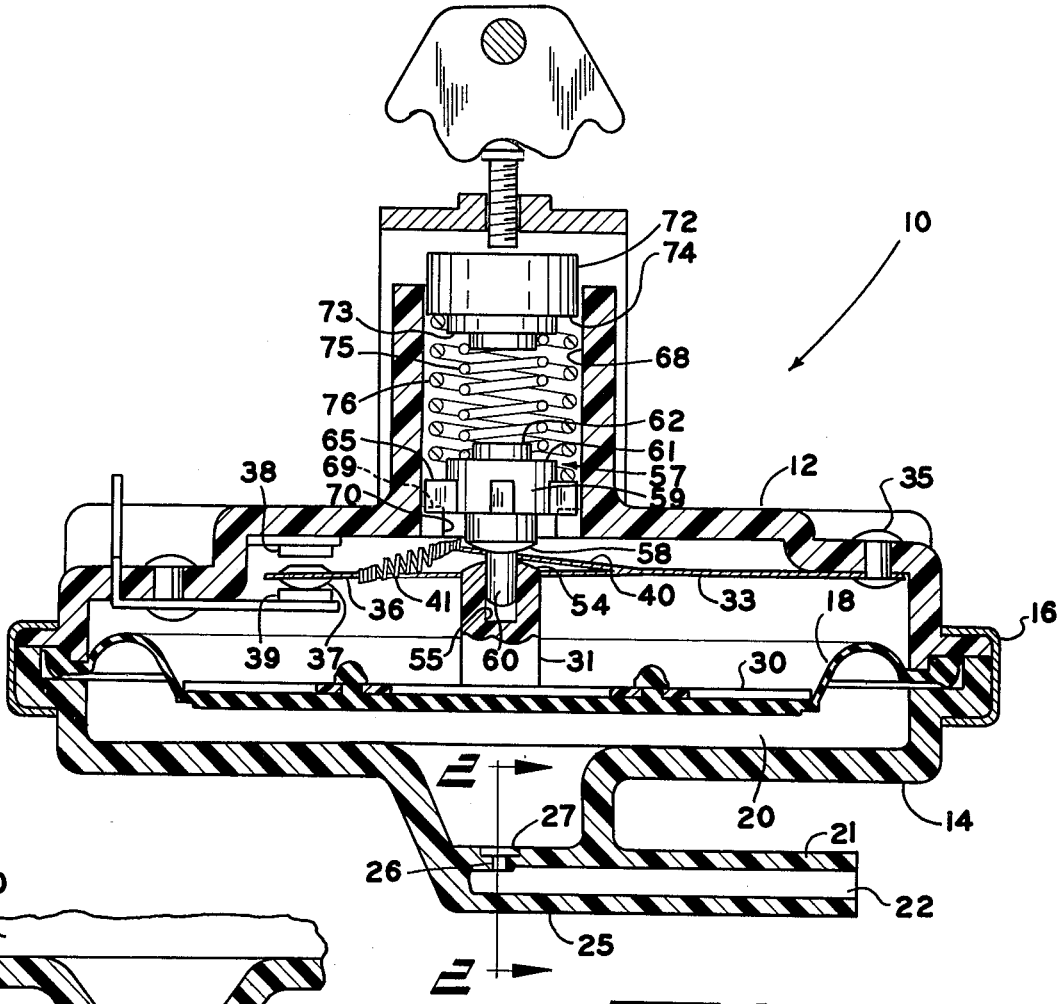
FIG. 1 is a sectioned elevation view of the pressure switch of the subject invention.

Referring now to the drawings which are for the purpose of illustrating a preferred embodiment of the invention, and not for limiting same, FIG. 1 shows the general arrangement of a pressure switch 10 of the subject invention.

The switch's outside configuration is defined by a plastic top housing portion 12 and a plastic bottom housing portion 14. Housing portions 12 and 14 have flanged ends which are joined together by a clamp ring 16 to sealingly compress the peripheral edge of a diaphragm 18 disposed within a recess therebetween in a known manner. Diaphragm 18 thus defines an expansible pressure chamber 20 on one side thereof and pressure chamber 20 is defined to at least partially include the interior of bottom housing portion 14.

Figure 2:
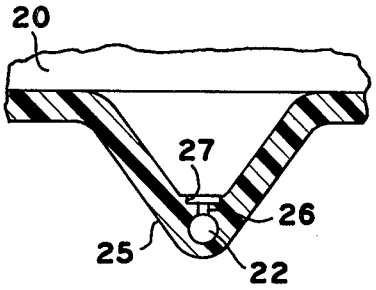
FIG. 2 is a sectioned view taken along line 2–2 of FIG. 1 illustrating the restrictive orifice of the subject invention.

As best shown in FIGS. 1 and 2 pressures is communicated to pressure chamber 20 by means of an inlet stem 21 molded into the bottom of bottom housing portion 14. Inlet stem 21 includes a relatively large, longitudinally extending passageway 22 formed in a rod segment of stem 21 which defines the inlet pressure line receiving end. Passageway 22 extends to the base end 25 of stem 21 which, as best shown in FIG. 2, is defined by a longitudinally extending "V" shaped wall section with passageway 22 positioned approximately in the center of the "V" apex. Fluid communication from passageway 22 to pressure chamber 20 is provided by a restrictive orifice 26 extending from passageway 22 through the inner wall portion of the V-shaped base end 25. Restrictive orifice 26 is defined by its diameter and length dimensions. In the embodiment shown the diameter of the orifice is maintained at approximately 0.025 inch which is greater than the orifice diameter formed in the metal caps of the prior art as explained above (0.020inch) but which is approximately the smallest opening which can, practically speaking, be molded in a plastic part such as bottom housing portion 14. To compensate for the large diameter of orifice 26, the length of the orifice opening is maintained significantly greater than that of the prior art and in the embodiment illustrated is approximately 1/16 of an inch. To accurately control the length of this dimension, a recess 27 is provided at the interior of the apex of the V-shaped base end 25.

A diaphragm plate 30 is secured to diaphragm 18 on the side thereof opposite the pressure chamber 20. A centrally located diaphram post 31 is formed as a portion of plate 30 and extends upwardly therefrom to contact a switch blade 33.

Switch blade 33, conventionally formed from yellow brass (ASTM spec. B36), is secured in a fixed manner to top housing portion 12 by rivet 35. Switch blade 33 is defined by an actuating tongue element 36 carrying a double contact 37 which is adapted to contact either a stationary upper contact 38 or a stationary lower contact 39, and is shown in FIG. 1 in contact with lower contact 39 to indicate an actuated position of the switch. Snap blade 33 further includes a guide tongue element 40 engaging diaphragm post 31. To effect snapping of switch blade 33 an overcenter spring shown herein as a barrel spring 41 functions as the toggle mechanism whereby movement of the guide tongue element 40 past "center" results in a snapping of the actuating tongue element 36 from one contact to another.

Figure 3:
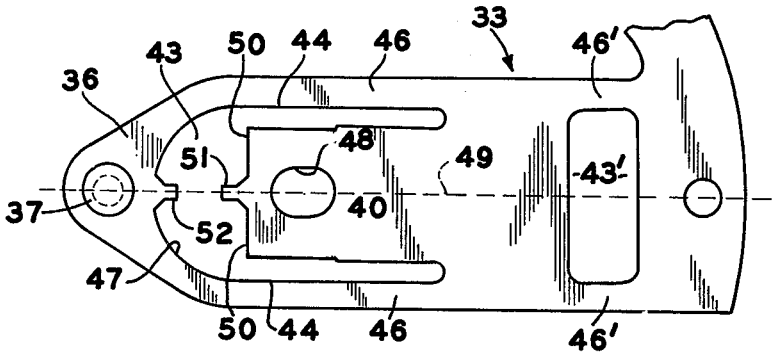
FIG. 3 is a plan view of the snap blade employed in the subject invention.

The construction of switch blade 33, as best shown in FIG. 3, is basically defined by a configured opening 43 formed in actuating tongue element 36 into which extends guide tongue element 40 which is contiguous, at its base, with the actuating tongue. More particularly, opening 43 is defined by spaced longitudinally extending edges 44 which extend parallel with one another to define what are commonly referred to as side rails 46 of the actuating tongue element 36. Longitudinal edges 44 blend into a circular edge surface 47 adjacent the contact carrying end of the actuating tongue element. Extending within opening 43 and contiguous with actuating tongue element 36 is guide tongue element 40 which is generally rectangular in configuration.

The longitudinally extending openings defined by side rails 46 and guide tongue element 40 have their terminal portions where the guide tongue element 40 is contiguous with actuating tongue element 36. If the blade 33 is viewed as having an overall length L, the terminal portion of the openings should be from about L/3 to about 2L/3, and preferably about L/2, from the "contact end" of the blade, i.e., the end at which the double contact 37 is located. The blade 33 also includes a pair of second side rails 46', extending longitudinally of the blade, defining therebetween an opening 43', the purpose of which is to make that section of the blade 33 relatively more flexible than the adjacent sections of the blade, especially the section between the terminal portions of the openings and the openings 43', so that the blade will preferentially bend in the section including opening 43'. This opening 43' should, for proper operation, extend from about L/5 to about L/3 from the fixed end of the blade, i.e., the end which is rigidly supported.

Guide tongue element 40 has an elongated opening 48 which is symmetrical about the longitudinal centerline 49 of the switch blade and positioned to be in alignment with diaphragm post 31. Extending from the forward edge 50 of guide tongue element 40 and from the center of circular edge surface 47 and symmetrical about the longitudinal centerline 49 of the blade is a guide tongue tab and an actuator tongue tab 51,52 respectively. Tabs 51,52 function as spring seats and guides for opposite ends of barrel spring 41. Importantly, tabs 51,52 and the tip end of the guide tongue element are not channelled, bent, or formed in any manner to increase the strength thereof as is common in prior art switches. Furthermore, the thickness of the blade body is uniform throughout and less than that of prior art switch blades, being nominally 0.007 inch and within the range of 0.006–0.008 inch.

The bottom surface of guide tongue element 40 is contacted by the end 54 of diaphragm post 31, end 54 is spherical in shape having a radius slightly greater than one half the maximum length of guide tongue opening 48. Formed within spherical end 54 of diaphragm post 31 is a blind guide stem bore 55 which is aligned with guide tongue opening 48. The upper surface of guide tongue element 40 is similarly contacted by an actuator 57. More particularly actuator 57 has a spherical surfce 58 depending from the body 59 thereof which has a spherical radius of approximately the same dimension as the spherical end 54 of the diaphragm post. Depending downwardly from spherical surface 58 is a cylindrical guide stud 60 which is received within guide stem bore 55 for aligning actuator 57 and diaphragm post 31 with one another. In the subject embodiment, guide stud 60 is longer than guide stem bore 55 to assure no binding of spherical surfaces 54,58 on opposite sides of guide tongue element 40. Alternatively, as is shown in FIG. 8 wherein like numerals refer to like elements, but with a prime attached, the guide stud 60' extends from the diaphragm post 31 and the guide stem bore 55 is within the actuator 57'.

Figure 4:
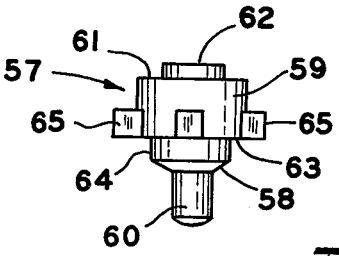
FIG. 4 is an elevational view of the actuator employed in the subject invention.

Actuator element 57 is best shown in FIG. 4 and may best be defined as comprising body portion 59 which is generally cylindrical in configuration. Body portion 59 has a top surface 61 which functions as a seat for one end of a trip-reset spring and has a circular boss 62 extending therefrom to serve as a guide for such spring. Depending from the bottom 63 of body portion 59 is a cylindrical spacer stud 64 which has spherical surface 58 formed at its end thereof from which in turn extends cylindrical guide stud 60. Extending radially outwardly from body portion 59 and molded flat with bottom surface 63 and extending upwardly therefrom a predetermined distance and a plurality of dog-ears 65 which herein are shown as 4 in number. Dog-ears 65 constrain the actuator to move only in an endwise direction within a cylindrical bore 68 formed in top housing portion 12.

Cylindrical bore 68 which is axially aligned with diaphragm post 31 has an annular spring seat 69 formed at its end adjacent switch blade 33. Spring seat 69 has a central opening 70 extending therethrough which is slightly greater in diameter than that of the actuator body portion 59 and in the embodiment shown has a height approximately equal to the height of the actuator body. Four radially extending slots (not shown) slightly greater than the width of the actuator dog-ears 65 and similarly oriented are provided in the spring seat and extend radially outwardly from opening 70. When actuator 57 is received within spring seat 69 and movable contact 37 engages stationary contact 38 to indicate an unactuated position of switch 10, the top surface of dog-ears 65 will be below the surface of spring seat 69. Some finite endwise movement of actuator 57 will thus be required before dog-ears 65 will protrude above spring seat 69.

At the opposite end of bore 68 is a known plunger 72 which has a first spring seat surface 73 for retaining one end of a reset trip spring 75 with the opposite end of reset trip spring 75 being seated on top surface 61 of actuator 57. A second trip spring 76 may also be provided in the arrangement for effecting proportional reset of switch 10. Second spring 76 is normally compressed between a second spring seat surface 74 on plunger 72 at one end and spring seat 69 in cylindrical bore 68 at its other end when the switch is in an unactuated position. When switch 10 is in its actuated position as shown in FIG. 1, second trip spring 76 will be compressed at its bottom end by dog-ears 65 of actuator 57.

With the appliance off, pressure chamber 20 is at atmospheric pressure and spring 75 bias switch blade 33 into its unactuated position defined as engagement between movable contact 37 and top stationary contact 38. When the appliance is turned on, after plunger 72 has been adjusted to some travel position which establishes a predetermined spring force exerted by actuator 57 on switch blade 33, the circuitry defined by contacts 38,37 will actuate a water valve to fill the tub. The head pressure developed by the tub filling will be communicated to pressure chamber 20 through restrictive orifice 26, which as hereinbefore noted averages transient water levels, both during fill and wash cycles, to result in an accurate, average pressure exerted on one side of diaphragm 18. The pressure in chamber 20 moves diaphragm post 31 to exert a force on the underside of the switch blade's guide tongue element 40 which is resisted by the spring force acting on the actuator on the opposite side of the guide tongue. As water level increases, the pressure acting on diaphragm 18 increases to eventually overcome the actuator spring force. At this point the guide tongue element 40 will begin to move towards its "center" trip position defined as being coplanar with actuating tongue element 36. Any slight movement beyond center will result in barrel spring 41 snapping the actuator tongue element 36 downwardly to break contact between movable contact 37 and stationary contact 38 which interrupts the circuitry to close the water fill valve.

Figure 5:
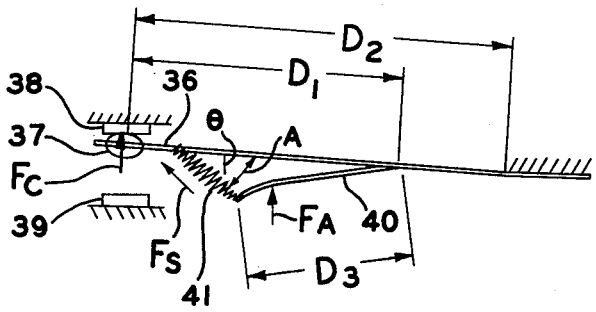
FIG. 5 is a schematic view illustrating the geometry of the snap blade.
Figure 3:
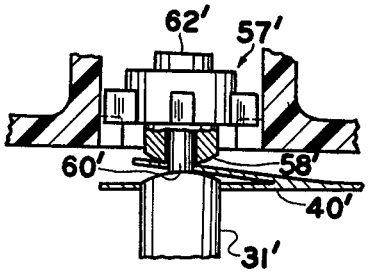
Figure 6:
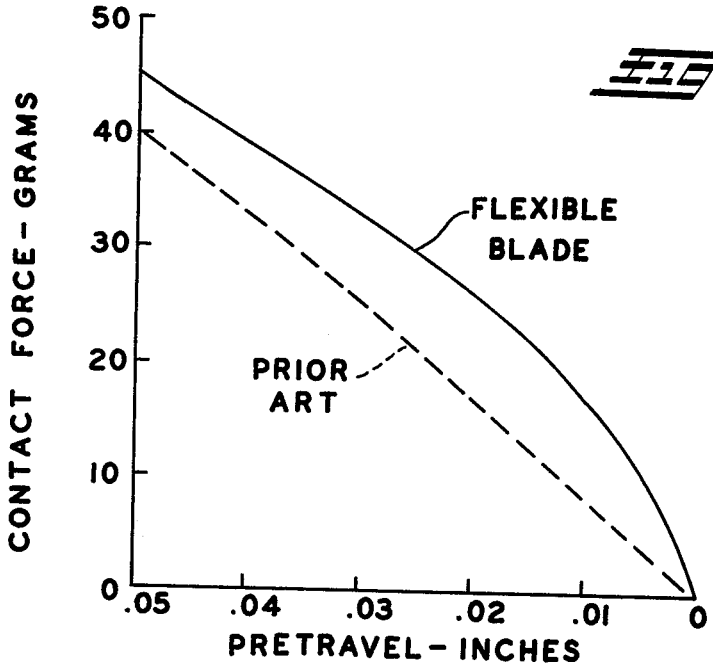
FIG. 6 is a graph of contact forces as the switch blade is moved towards its center position.
Figure 7A:
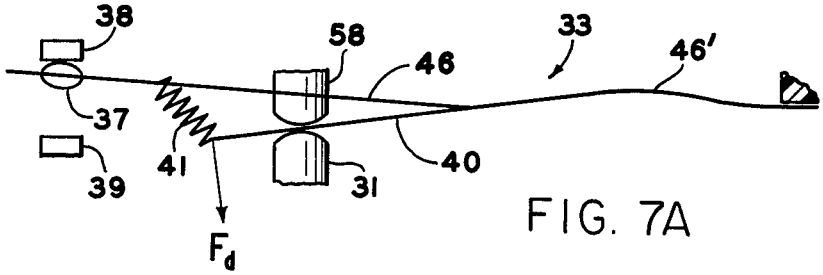
FIG. 7 (A–D) is a schematic illustration of the changes in configuration of the snap blade at the time of actuation, on the same scale as FIG. 3.
Figure 7B:
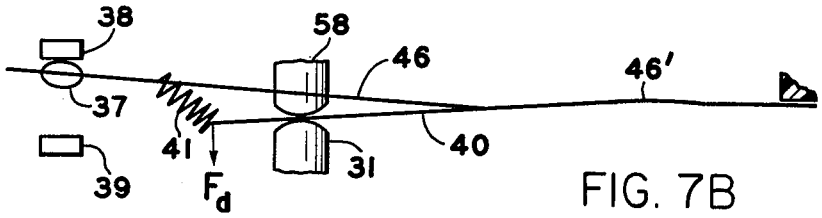
Figure 7C:
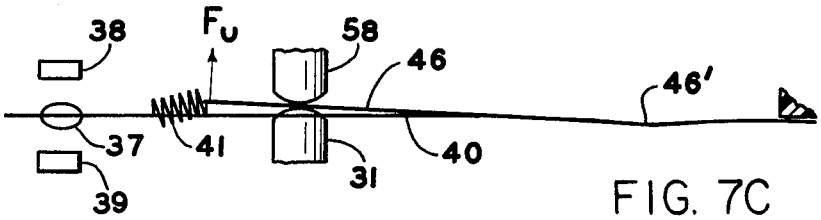
Figure 7D:
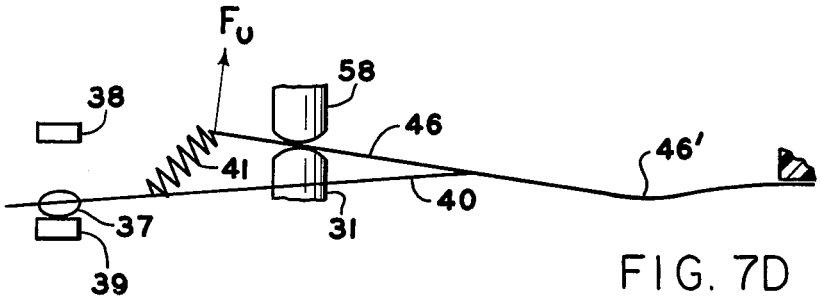

The contact force developed between movable contact 37 and stationary contacts 38,39 by switch blade 33 may best be determined by reference to FIG. 5 which schematically illustrates switch blade geometry. More particularly, the contact force $F_c$ is a function of the spring force $F_s$ acting on the actuator tongue element 36, and corresponds to the equation $F_c = K \times F_s \times$ sine A where angle A is the attitude of spring 41 with respect to the actuating tongue element 36; sine A is equal to effective guide tongue length divided by the effective actuating tongue length, $D_3/D_1$, and may be assumed linear since angle A is less than 25°; and K is defined as a lever ratio shown herein as $D_1/D_2$. When the diaphragm force $F_d$ overcomes the opposing spring force and begins to move guide tongue 40 towards actuating tongue element 36, angle A will decrease and the contact force $F_c$ will decrease proportionately. As noted above, in prior art switches, guide tongue element 40 and spring seat tabs 51,52 were rigidized and this resulted in the contact force decreasing linearly as a direct function of the guide tongue element travel as shown in FIG. 6. In accordance with the subject invention, the switch blade is flexible with the result that the tip of the guide tongue element 40 deforms itself about the spherical surface 54,58 of the diaphragm post or actuator respectively depending upon the contact position of the switch blade. This results in an increase in angle A over the prior art which maintains a greater contact force as shown in FIG. 6 to prevent arcing between contacts as the switch blade is moved to trip position. Importantly, as the spring 41 is compressed the flexible tip of the guide tongue may continue to deflect somewhat thus preventing the constant rapid linear reduction of the contact force just prior to the tripping of the switch blade. Tests have indicated that switch blades of the subject invention have prevented erosion failures of the contact points and have thus extended the life of the switch blade. More particularly it is estimated that only 3% of all blades produced will fail within an average working machine life span of 20 years.

FIG. 7 shows schematically, and on the same scale as FIG. 3, the different stages and configurations of the snap blade 33 in the actuation of the pressure switch, which has been generally described above. In 7(A), the actuator and blade are at rest with the double contact 37 held firmly against the stationary contact 38. The slight bow in the blade in the area of second side rails 46' is the result of the generally downward force $F_d$ exerted on guide tongue 40 by the toggle spring, causing the guide tongue to pivot about the actuator. In FIG. 7(B), as the actuator moves upward, just before the "trip", the downward force $F_d$ on the guide tongue decreases, decreasing the pivotal force thereon, thus permitting the blade to become straighter. In FIG. 7(C), the guide tongue has just passed the center "trip" position and the toggle spring is now exerting a slight upward force $F_u$ on the tongue, tending to pivot it about the actuator, imparting a slight downward bow in the blade, in the area of second side rails 46'. FIG. 7(D) shows the conditions at contact closure, with the toggle spring now exerting a greater force $F_u$ on the guide tongue, which in turn is pivoted about the actuator, exerting a greater force, at the base of the guide tongue, on the remainder of the blade. This pivoting action of the guide tongue exerts a force on the pivot point of the actuating tongue element in the same direction as the double contact has been moving, thus minimizing the chance for the double contact to bounce off of the stationary contact 39. Although a specific blade geometry has been illustrated, it should be clearly understood that this aspect of the present invention is not limited to any particular configuration of blade, but is intended to include any blade geometry which is capable of functioning as shown in FIG. 7. It is required only that the actuating tongue element pivot with respect to the guide tongue in the central section of the blade and that between this pivot point and the support end there be a relatively more flexible section of the blade, to permit bending as illustrated. To further minimize the contact bounce, it may be desirable for the faces of the stationary contacts to be oriented at slight angles with respect to a horizontal plane, or with respect to a reference plane defined by the snap blade in an unbiased condition. The angle is preferably from about 3° to about 11°.

As hereinbefore stated the diaphragm must overcome the spring force exerted on the actuator to trip the switch and conversely when the water-fill level is drained the spring forces exerted on the actuator must reset the switch blade. In most appliances the pressure switch must provide various trip levels and reset levels. The relationship between the trip curve and the reset curve both of which are linear (because of spring force) may be a constant difference (i.e. constant differential reset) for example 3 inches of water, or may be an increasing difference that is proportinal to the change in the trip curve (i.e. proportional differential reset). When a constant differential reset is desired only reset-trip spring 75 is employed in the plunger arrangement as described above. When a proportional differential reset is desired second spring 76 is employed. When switch blade 33 moves to its trip position, dog-ears 65, at some endwise travel distance of the actuator, compress the trip spring 76 and thus both the reset trip spring 75 and trip spring 76 oppose tripping of the switch blade. During reset the trip spring 76 will seat against spring seat 69 and bore 68 so that only reset trip spring 75 controls the reset of the switch blade. In both applications, actuator 57 provides an extremely stabilized spring arrangement permitting accurate switch point control while also resulting in an extremely simple uncomplicated arrangement easy to manufacture at low cost.

The invention has been described with reference to a preferred embodiment. Obviously modifications and alterations will occur to others, upon reading and understanding the specification. For example, the selective spring compression travels determined by the dog-ear arrangement of the actuator could be established so that only the reset trip spring 75 would control a mini-wash setting at extra-low pressure while the second trip spring 76 in combination with the first reset-trip spring 75 would control the normal "low to high" tub fill settings. It is my intention to include all such modifications and alterations insofar as they come within the scope of the present invention.

I claim:

1. A pressure switch comprising:

first and second housing portions;

diaphragm means between said housing portions defining an expansible pressure chamber on one side of said diaphragm means at least partially within said second housing portion;

switch means on the opposite side of said diaphragm movable from a normal to an actuated position by said diaphragm means, said switch means including a snap blade having a guide tongue element operatively associated with said diaphragm means and an actuating tongue element carrying a contact movable between said positions;

said first housing portion having a bore aligned with said guide tongue and an annular base within said bore adjacent said guide tongue, said annular base defining a central opening extending therethrough and at least two configured slots extending outwardly from said opening and extending through said bore;

adjustable spring means within said bore for biasing said guide tongue and said blade to said normal position, said spring means including an actuator having a body portion disposed within said opening in said base and at least two ears extending from said body generally conforming to the shape of said slots and received therein, said actuator at least partially disposed within said base and contacting said guide tongue element;

said guide tongue has an elongated slot therethrough;

said diaphragm means includes a resilient diaphragm, a relatively rigid plate secured to said diaphragm and an actuating post extending from said diaphragm plate, said actuating post having a generally spherical end abutting said guide tongue element and an opening extending within said actuating post from said spherical end, said opening generally aligned with said slot in said guide tongue; and said actuator has a spherical portion depending from the body thereof and contacting said guide tongue and a guide stem portion depending from said spherical portion and received within said opening in said actuating post.

2. The pressure switch of claim 1 wherein said adjustable spring means further includes an adjustable plunger at least partially disposed within said bore remote from said base thereof, said plunger conforming in shape to said opening and having a centrally positioned boss depending therefrom within said bore;

said actuator having a centrally positioned boss extending therefrom within said bore;

a first spring within said bore between said actuator and said plunger and having ends receiving said bosses, said first spring effective to establish constant differential reset of said switch; and said adjustable spring means further includes a second spring within said bore between said plunger and said base of said bore, said second spring in combination with said first spring effective to establish proportional differential reset of said switch.

3. The pressure switch of claim 1 wherein said housing portions are molded of plastic; and an inlet is contiguously formed within said second housing in fluid communication with said expansible chamber and an orifice formed within said inlet.

4. The pressure switch of claim 3 wherein said orifice has a minimum diameter of 0.025 inch.

* * * * *